US012653285B2

(12) United States Patent
Mayer

(10) Patent No.: US 12,653,285 B2
(45) Date of Patent: Jun. 16, 2026

(54) HOLDING DEVICE FOR CARDS AND/OR BANK NOTES

(71) Applicant: Frank F. E. Mayer, Bad Duerkheim (DE)

(72) Inventor: Frank F. E. Mayer, Bad Duerkheim (DE)

( * ) Notice: Subject to any disclaimer, the term of this patent is extended or adjusted under 35 U.S.C. 154(b) by 9 days.

(21) Appl. No.: 19/007,656

(22) Filed: Jan. 2, 2025

(65) Prior Publication Data

US 2025/0127269 A1 Apr. 24, 2025

Related U.S. Application Data

(62) Division of application No. 17/924,157, filed as application No. PCT/EP2021/064159 on May 27, 2021, now abandoned.

(30) Foreign Application Priority Data

May 29, 2020 (DE) ..... 20 2020 103 097.3
Oct. 21, 2020 (DE) ..... 10 2020 127 669.9

(51) Int. Cl.
*A45C 1/06* (2006.01)

(52) U.S. Cl.
CPC ..... *A45C 1/06* (2013.01); *A45C 2001/062* (2013.01); *A45C 2001/065* (2013.01); *A45C 2001/067* (2013.01)

(58) Field of Classification Search
CPC ..... A45C 1/06; A45C 2001/062; A45C 2001/065; A45C 2001/067
See application file for complete search history.

(56) References Cited

U.S. PATENT DOCUMENTS 2,099,122 A * 11/1937 Kreisler ..... A45C 13/16
220/259.5
7,617,928 B1 11/2009 Murphy
11,547,188 B2 * 1/2023 Myers ..... A45F 5/021
2011/0277892 A1 * 11/2011 Black ..... A45C 1/06
150/148
2012/0067747 A1 3/2012 Van Geer
2014/0060712 A1 * 3/2014 Beckley ..... A45C 1/06
150/133

(Continued)

FOREIGN PATENT DOCUMENTS

CN 102448343 A 5/2012
CN 104302204 A 1/2015
CN 108618321 A * 10/2018 ..... A45C 11/18

(Continued)

OTHER PUBLICATIONS

Decision To Grant with Translation in JP 2022-573553 dated Apr. 22, 2025.

*Primary Examiner* — Tri M Mai
(74) *Attorney, Agent, or Firm* — Collard & Roe, P.C.

(57) ABSTRACT

A holding device for cards and/or bank notes includes a housing for accommodating the cards and/or bank notes, wherein the housing thereof can be extended as easily as possible using exchangeable parts, wherein cards accommodated in the housing are held as gently and safely as possible. The housing includes a sliding element which extends over a corner region of the housing, and/or is part of a sliding element structure which extends over a corner region of the housing.

13 Claims, 20 Drawing Sheets

(56) References Cited

U.S. PATENT DOCUMENTS

| | | | |
|---|---|---|---|
| 2014/0284227 | A1 | 9/2014 | Mayer |
| 2019/0269213 | A1 | 9/2019 | Deng |

FOREIGN PATENT DOCUMENTS

| | | | | | |
|---|---|---|---|---|---|
| DE | 202018106998 | U1 * | 12/2018 | ..... | A45C 11/182 |
| JP | S58-55622 | U | 4/1983 | | |
| JP | H11-266917 | A | 10/1999 | | |
| JP | 2000-300327 | A | 10/2000 | | |
| JP | 2000-328101 | A | 11/2000 | | |
| JP | 3177914 | U | 8/2012 | | |
| JP | 2012-527946 | A | 11/2012 | | |
| JP | 2014-532490 | A | 12/2014 | | |
| WO | 2019243082 | A1 | 12/2019 | | |

* cited by examiner

HOLDING DEVICE FOR CARDS AND/OR BANK NOTES

CROSS REFERENCE TO RELATED APPLICATIONS

This application is a divisional of and Applicant claims priority under 35 U.S.C. §§ 120 and 121 of U.S. application Ser. No. 17/924,157 filed on Nov. 9, 2022, which application is a national stage application under 35 U.S.C. § 371 of PCT Application No. PCT/EP2021/064159 filed on May 27, 2021, which claims priority under 35 U.S.C. § 119 from German Application No. 20 2020 103 097.3 filed on May 29, 2020 and German Application No. 10 2020 127 669.9 filed on Oct. 21, 2020, the disclosures of each of which are hereby incorporated by reference. Certified copies of priority German Patent Application Nos. 20 2020 103 097.3 and 10 2020 127 669.9 are contained in parent U.S. Application Ser. No. 17/924, 157. The International Application under PCT article 21 (2) was not published in English.

BACKGROUND OF THE INVENTION

1. Field of the Invention

The invention relates to a holding device for cards and/or banknotes.

2. Description of the Related Art

Such a holding device is already known from WO 2019/243 082 A1, which device is produced by means of powder injection molding and is provided with sliding elements. In particular, sliding elements protect credit cards and their magnetic strips when these are being pushed into the housing or being pulled out of it. However, the sliding elements also serve as brakes or retainer elements, so that the cards do not fall out or slip out of the housing in an undesired manner.

Against this background, a need exists to structure such a housing as individually as possible, for example with different lids, without the quality of the hold on the cards suffering. Furthermore, it should be possible to hold many different types of credit cards in the housing in a secure and gentle manner.

SUMMARY OF THE INVENTION

The invention is therefore based on the task of indicating a holding device for cards and/or banknotes, the housing of which device can be supplemented without problems by using exchangeable parts, wherein cards held in the housing are held in the most gentle and secure manner possible.

The stated task is accomplished by means of the characteristics of the invention.

According to the invention, it has been recognized that a sliding element that extends over a corner region of the housing and/or is a fixed or loose part of a sliding element structure that extends over a corner region of the housing can be introduced into the housing in a very firm and reliable manner, specifically even after production of the housing. By means of the placement across the corner, the sliding element or the sliding element structure can be fixed in place in the housing in a stable manner, with force fit, shape fit, material fit and/or friction fit. In particular, cards are inserted, protected, and held in a defined manner, in particular also in the corners of the housing.

A sliding element structure produced separately from the housing could be assigned to the housing, which structure comprises at least one sliding element and at least one contact leg to be laid against an inner wall of the housing, wherein the sliding element and the contact leg lie against one another. A sliding element structure produced separately from the housing can be inserted into a housing subsequently, in other words after its production from a specific material. A sliding element can protect cards. A contact leg can reduce the inside diameter of the housing when it is laid against an inner wall, and can thereby exert a clamping effect on the cards. Furthermore, a contact leg can stabilize a wall of the housing if the housing is produced from a brittle material. A sliding element that lies against a contact leg can fix the latter in place. The same holds true if the sliding element is connected with the contact leg or configured in one piece with it.

The housing could be open toward the top and have a bottom, wherein side crosspieces that project upward and are arranged at a distance from one another are assigned to the bottom. Thus, cards can be very easily introduced into the housing not just from the front but also coming from above, and can be removed from it in an upward direction.

At least one sliding element could be configured to be plastically deformable and/or flexible. In this way, a sliding element can be deformed and clipped into a cavity. After being clipped in, the sliding element can exert a force on a contact leg, so that the latter is fixed in place or stabilized with force fit and/or shape fit. Alternatively or in addition, at least one contact leg could be configured to be elastically deformable and/or flexible. Such a contact leg can be inserted into a housing as a flexible inlay, in particular with a sliding element formed on it or sliding elements formed on it in one piece and preferably using the same material.

At least one sliding element could have an element on the bottom side, which is held in a depression of the bottom or held with shape fit, and in this regard presses itself and/or the contact leg against a side crosspiece. The sliding element can support itself in the depression against the depression walls and exert a force on the side crosspiece.

At least one sliding element could have an element on the bottom side, which is held in a depression of the bottom, and could have an element on the side crosspiece side that rises up from the element on the bottom side and is enclosed, at least in certain regions, by the contact leg or side crosspiece. As a result, a part of the sliding element can disappear almost completely in the bottom, and another part can disappear almost completely in the inner wall of the housing. Furthermore, such a sliding element, which runs quasi across the corner, can be easily clipped in if a contact leg already lies against the side crosspiece, for example is glued onto it. The sliding element does not disappear completely in the bottom or the inner wall, but rather projects into the interior of the housing with a planar protrusion, so that cards can slide on this protrusion.

Against this background, the side crosspiece could have a gap on its inner wall, which gap holds or encloses the element on the side crosspiece side, wherein the gap is formed out of the side crosspiece. In such a case, a separate contact leg is not necessary, because gaps can be milled directly out of the side crosspiece.

Holding ribs or holding rivets for passing through holes in the edge of a cover could extend between a contact leg and a side crosspiece. In this way, the cover is fixed in place. The holding ribs or holding rivets can be arranged on the side crosspiece, on the contact leg or on both parts. Holding ribs can engage into one another with shape fit.

Against this background, first holding ribs could be formed on the side crosspiece, which ribs are configured complementary to second holding ribs on the contact leg, so that the second holding ribs can engage into the first holding ribs. In this way, fixation of the contact leg on the side crosspiece takes place, supported by an element of the sliding element that is on the bottom side.

At least one cover could be provided, which is held indirectly or directly by means of the sliding element structure that lines the housing, at least in certain sections. Such a cover can cover the housing and protect cards or banknotes against access. The cover is preferably configured to be flexible. Particularly preferably, the cover is produced from leather, a textile or a rubber.

At least one contact leg could be configured to be elongated and/or at least one contact leg could lie indirectly or directly against at least one inner wall of the housing, namely a side crosspiece. In this way, effective lining and stabilization of the housing take place. The contact leg could function as an inner wall that can be stabilized by means of the inserted card or multiple inserted cards. The cards can press against the contact leg in the inserted state and thereby secure and stabilize it.

The contact leg could function as a brake for cards to be inserted and/or can produce an undersize and/or can have a wave structure. By means of the undersize or a wave structure, which in turn produces an undersize in certain sections, a clamping effect can be exerted on cards. An undersize is a width from inner wall to inner wall within the housing, which width is less than the width of a card. The contact leg can exert a braking effect on a card on the basis of an undersize or on the basis of production from a specific material, so that the card does not fall out of the housing.

At least one latching element could be assigned to at least one contact leg, which element engages into at least one recess and/or at least one undercut of the housing. In this way, the sliding element structure can be latched in place in the housing with shape fit, in a reversible manner.

At least one clip could be held in the housing. It can be possible to set the clip into the housing in a replaceable manner. The clip can press down onto banknotes or cards from above and additionally fix them in place.

By means of the presence of the sliding element and/or of the sliding element structure within the housing, an insertion width for a card can be produced along a defined clamping length, at least in certain sections, wherein the insertion width is greater than 52 mm and less than 53.98 mm. It is advantageous if inner contact surfaces are formed by means of the sliding elements or sliding element structures, which surfaces clamp a card at least slightly and prevent it from falling out of the housing. In this regard, the insertion width is a distance between inner contact surfaces, wherein this distance can be present in certain sections or over the entire length of the housing.

Holding rivets can extend between a contact leg and a side crosspiece, which rivets project through holes in the contact leg and/or through holes in the side crosspiece, wherein the holding rivets are connected with rivet heads that project into holes in the contact leg and/or into holes in the side crosspiece. Preferably a holding rivet and a rivet head enter into a snap connection. Such a connection is reversibly releasable. However, it is also conceivable that a holding rivet and a rivet head enter into a screw connection. The contact leg can preferably be engaged into the housing continuously along its expanse.

A contact leg could lie against a side crosspiece and engage into it with at least one protrusion or a stud and/or pass through the side crosspiece with at least one protrusion and/or a stud and/or a coupling piece. The studs and protrusions serve for correct orientation of the contact leg relative to the side crosspiece or relative to the housing. The coupling piece can pass through a side crosspiece, so that a cover can be reversibly connected with the coupling piece. The cover can therefore be easily released from the coupling piece and folded away during use of the holding device, so as to be better able to access cards or banknotes in the housing.

An inner wall of the housing could be configured to be bulbously convex and/or a contact leg could have or form such an inner wall. By means of an inner wall that arches into the interior of the housing in a convex manner, cards can be clamped more in the tightest locations of the interior or have more friction applied to them than cards that lie on the bottom or at the upper opening. The cards that lie on the bottom, namely on an access opening or selection window formed by the bottom, can therefore be pulled out of the stack of cards more easily than the cards that lie in the middle of the card stack.

A contact leg could have a first coupling piece part that engages into a second coupling piece part, wherein one coupling piece part or both coupling piece parts pass through a passage in a side crosspiece. In this way, the second coupling piece part can lie against the inner wall of the side crosspiece, on the one hand, and at the same time form the male part of a snap for a lid, which part projects away outward. The first coupling piece part preferably engages into the second coupling piece part with shape fit. It is also conceivable that the second coupling piece part is crimped onto, glued onto and/or pressed onto the first coupling piece part. In this regard, a material fit, force fit and/or shape fit connection of the two coupling piece parts is conceivable.

The second coupling piece part is preferably produced from a metal. In this way, a high-quality metallic coupling piece part, in particular one that is made of a precious metal, can be set onto a first coupling piece part made of plastic, which is formed in one piece with and from the same material as the first contact leg. Against this background, the housing itself could also be produced from a metal, in particular a precious metal, wherein the contact legs are produced from plastic.

A contact leg could have a tongue for engaging around corners of plastic cards inserted into the housing. In this way, plastic cards could be protected from friction wear. Furthermore, the tongue prevents plastic cards from slipping out of the housing in an undesired manner.

Cards can slide gently on the sliding elements described here. The sliding elements are preferably produced from a softer material than the housing, so as to protect the cards. In particular if a housing has been produced using powder injection molding, it can have a rough bottom, so that the cards can be protected when they are pushed in and pulled out, by being spaced apart from the bottom by means of sliding elements.

A retrofitting set for the aforementioned holding device advantageously comprises a cover and/or a sliding element structure and/or a sliding element and/or a removable contact leg that functions as an inner wall.

The housing could consist of titanium, of a precious metal, of a ceramic or of a carbon material. The housing could particularly be produced by means of powder injection molding.

A sliding element in the sense of this specification can exert a braking effect, namely a retentive effect on a card in the housing, so that the card does not fall out of the housing in an undesired manner.

Alternatively or in addition, a sliding element in the sense of this specification can bring about gentle handling of a card when it is inserted into the housing and/or stored in it. The sliding element then brings about sliding of the card on the sliding element and not on the bottom of the housing. By means of the sliding element, the card is spaced apart from the bottom, at least in certain regions or entirely.

Both a total sliding element structure and its individual parts, for example an individual sliding element or a contact leg, can be fixed in place in the housing using an adhesive.

DETAILED DESCRIPTION OF THE PREFERRED EMBODIMENTS

Figure 1:
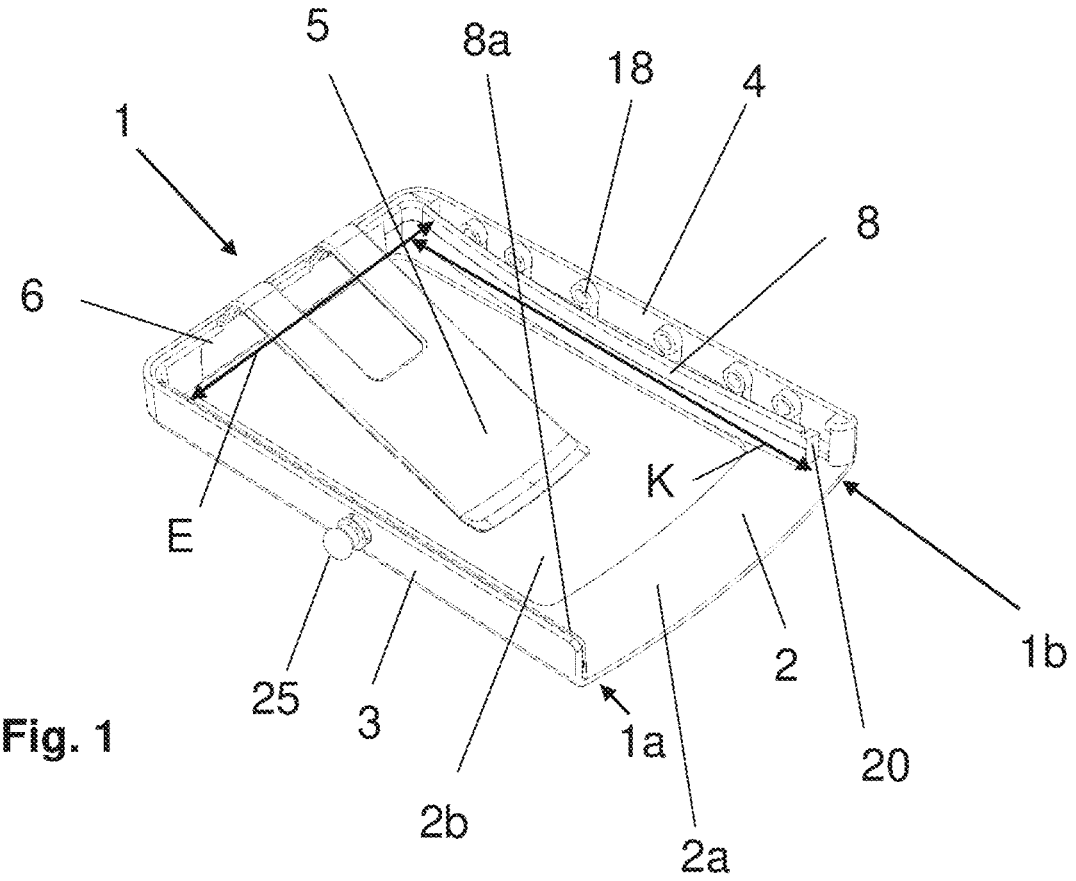
FIG. 1 shows a perspective view of a holding device having a housing and a clip and a second contact leg for fixing a replaceable cover in place, which shank has not yet been installed completely.

FIG. 1 shows a holding device for cards and/or banknotes, comprising a housing 1 that is open toward the top and has a bottom 2, wherein side crosspieces 3, 4 that project upward and are arranged at a distance from one another are assigned to the bottom 2, and wherein at least one clip 5 is provided, which projects into the housing 1 from above, in the direction of the bottom 2, so as to press cards and/or banknotes against the bottom 2.

The side crosspieces 3, 4 are connected with one another, only on a back side of the housing 1, by means of a connection crosspiece 6 that stands orthogonal to the bottom 2. From the front side, cards or credit cards can be pushed into the housing 1 in the manner of a drawer, until they make contact with the connection crosspiece 6 or other stops.

The bottom 2 furthermore has a front flat transverse crosspiece 2*a*, followed by an access opening 2*b* in the direction of the connection crosspiece 6. Cards can be moved using a finger or a thumb, through the access opening 2*b*. The thumb or finger then projects from below through the access opening 2*b* in the direction of the clip 5, which comes from above. The flat transverse crosspiece 2*a* lies flush with the bottom 2 and is part of the bottom 2. The clip 5 can be reversibly inserted into the housing 1 as an exchangeable part. For this reason, at least one clip 5 is held in the housing 1.

Figure 2:
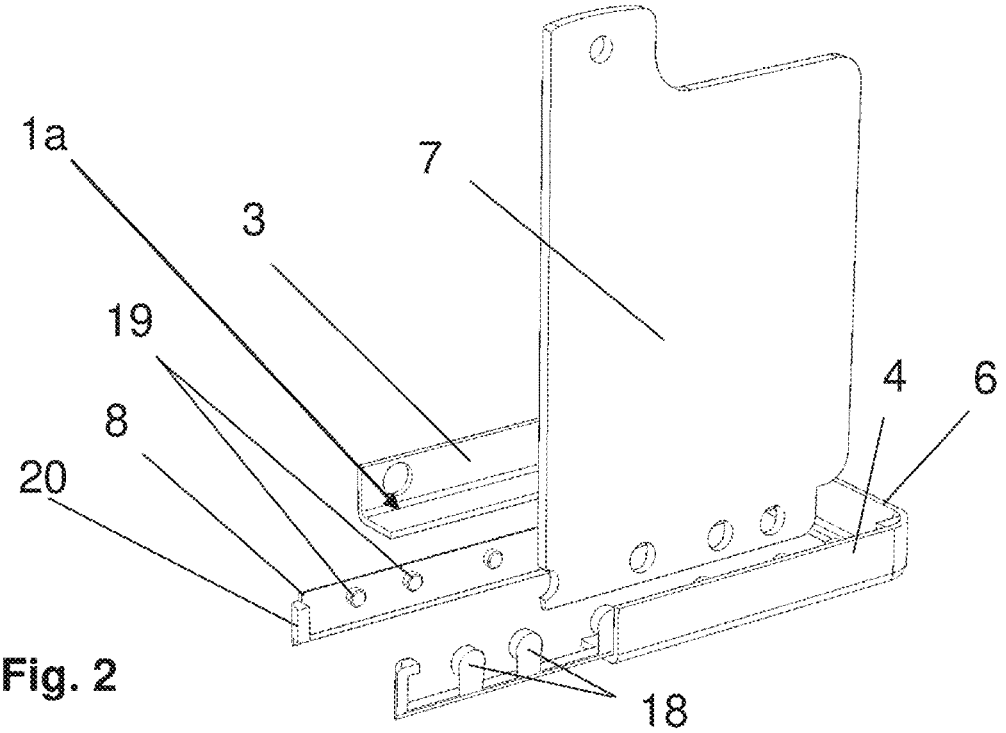
FIG. 2 shows a schematic view, partly in section, in which it is shown that the second contact leg can hold a replaceable cover between itself and the second side crosspiece, and fix it in place.
Figure 3D:
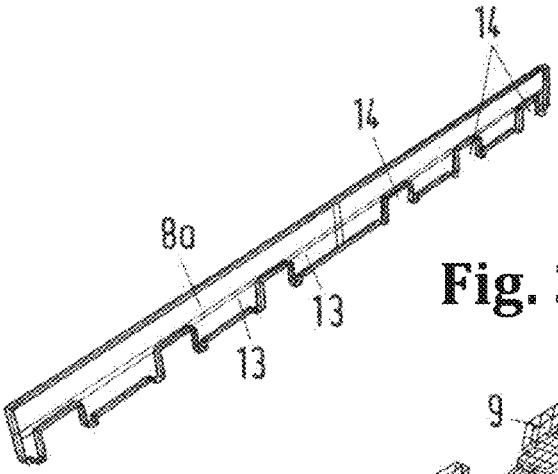
FIG. 3D shows the first contact leg.
Figure 3C:
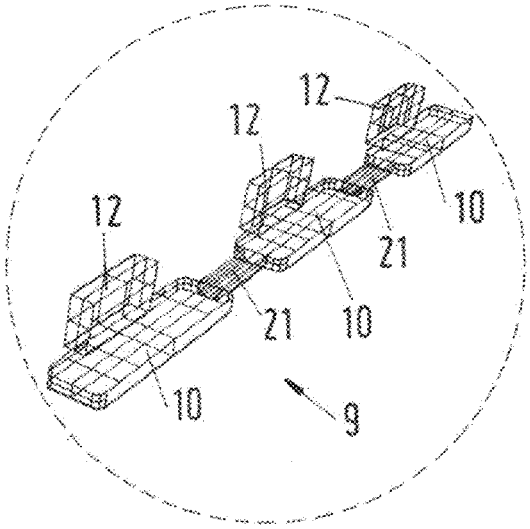
FIG. 3C shows a magnified representation of a first sliding element.
Figure 3B:
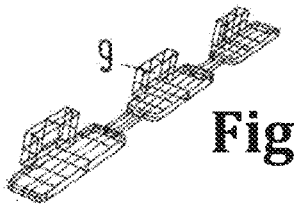
FIG. 3B shows the two first sliding elements that can be inserted.
Figure 3A:
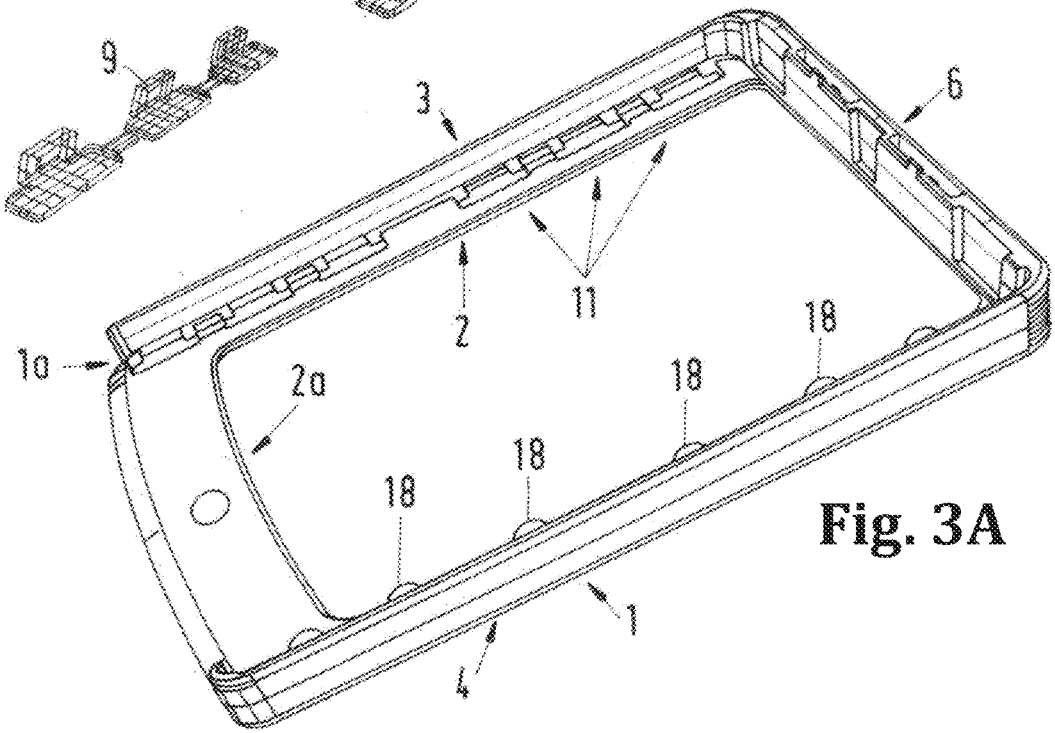
FIG. 3A shows the housing of the holding device, into the bottom of which two first sliding elements can be set, which fix a first contact leg in place by means of shape fit.

FIG. 2 schematically shows, partly in section, that a cover 7 is provided, which is held by means of a sliding element structure that lines the housing 1, at least in certain sections, wherein the sliding element structure is configured as a component produced separately from the housing 1 and has at least one contact leg 8 for reversible shape-fit, force-fit and/or material-fit contact with the housing 1 and for reversible insertion into the housing 1. The cover 7 can be inserted into the housing 1 through a slot. The contact leg 8, which is present separately from the housing 1, is configured to be elongated and lies against an inner wall of the housing 1, namely the side crosspiece 4, with the interposition of the cover 7. The contact leg 8 thereby itself forms an inner wall, which holds the cover 7. The cover 7 is therefore reversibly interchangeable, and the contact leg 8 can be held and/or stabilized by cards that are inserted into the housing 1.

FIGS. 3A-3D show the holding device for cards and/or banknotes, comprising a housing 1 that is open toward the top, which housing has a bottom 2, wherein side crosspieces 3, 4 that project upward and are arranged at a distance from one another are assigned to the bottom 2, however without the clip 5.

FIGS. 3A-3D and FIG. 5D show the housing 1 for holding the cards and/or banknotes, wherein the housing 1 comprises two sliding elements 9, which extend over a corner region 1*a* of the housing 1 and are configured to have an angle.

In this concrete case, a sliding element structure produced separately from the housing 1 is assigned to the housing 1, which structure comprises first sliding elements 9 and a first contact leg 8*a* for being laid against an inner wall of the housing 1. The first sliding elements 9 and the first contact leg 8*a* lie against one another after assembly. A first sliding element 9 is configured to be elastically deformable.

A first sliding element 9 has elements 10 on the bottom side, which are held with shape fit in a depression 11 of the bottom 2 formed complementary to them. In this regard, each first sliding element 9 presses the first contact leg 8*a* against the first side crosspiece 3. A first sliding element 9 has three elements 10 on the bottom side, which are held in the depression 11 of the bottom 2, and three elements 12 on the side crosspiece side, which rise up from the elements 10 on the bottom side and are enclosed by the contact leg 8*a*. For this purpose, the first contact leg 8*a* is configured in the manner of a palisade. The first contact leg 8*a* is pressed against the side crosspiece 3 at locations 13 by each element 10 of a first sliding element 9 on the bottom side, and encloses an element 12 on the side crosspiece side with a gap 14, in each instance. The first contact leg 8*a* is first glued onto the first side crosspiece 3, then the first sliding elements 9 are clipped in place, so that these permanently press the first contact leg 8*a* against the first side crosspiece 3.

Figure 4C:
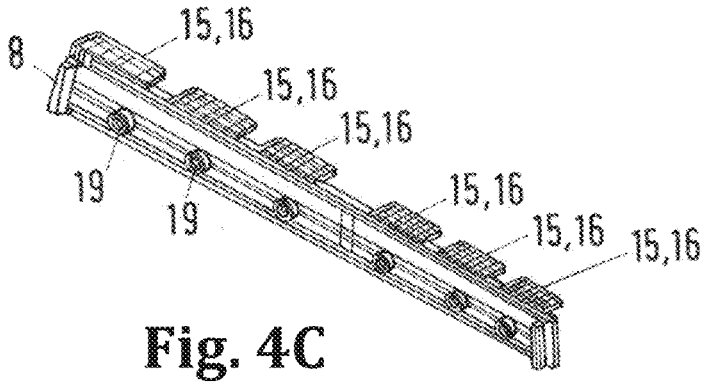
FIG. 4C shows a perspective view of the second contact leg.
Figure 4B:
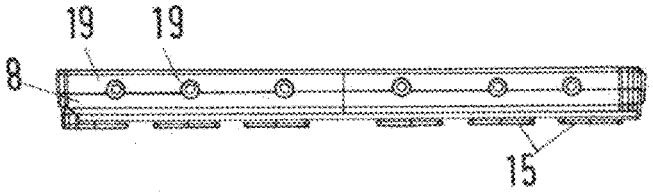
FIG. 4B shows a top view of the side of the second contact leg, which faces the second side crosspiece.
Figure 4A:
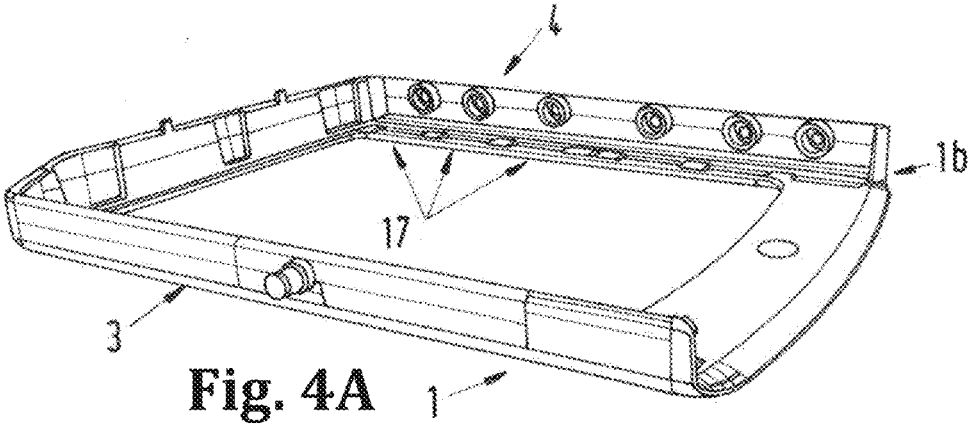
FIG. 4A shows the housing of the holding device, into the bottom of which two second sliding elements can be inserted, together with a second contact leg that is formed on them in one piece.

FIGS. 4A-4C show the holding device for cards and/or banknotes, comprising the housing 1 that is open toward the top, once again without clip 5.

FIGS. 4A-4C and FIG. 5D show that the housing 1 comprises second sliding elements 15 that are parts of an angled sliding element structure that extends over a corner region 1*b* of the housing 1.

In this concrete case, the housing 1 has a sliding element structure produced separately from the housing 1 assigned to it, which structure comprises second sliding elements 15 and a second contact leg 8 for lying against an inner wall of the housing 1. The second sliding elements 15 and the second contact leg 8 are connected with one another and configured in one piece. The second sliding elements 15 are configured to be elastically deformable.

Each second sliding element 15 has an element 16 on the bottom side, which is held with shape fit in a second depression 17 of the bottom 2, configured to be complementary to it, in each instance, and thereby presses the second contact leg 8 against the second side crosspiece 4.

Holding ribs 18, 19 for passing through holes in the edge of the cover 7, which is shown in FIG. 2, extend between the second contact leg 8 and the second side crosspiece 4. First holding ribs 18 are formed on the second side crosspiece 4, which ribs are configured complementary to second holding ribs 19 on the second contact leg 8, so that the second holding ribs 19 can engage into the first holding ribs 18. In this concrete case, the second holding ribs 19 can be inserted in pin manner into the first holding ribs 18, which have holding parts. However, the first holding ribs 18 can also engage into the second holding ribs 19 in pin manner, if these were to form a corresponding holding part. As is evident from FIG. 2, at least one cover 7 is provided, which is held, indirectly or directly, by means of the sliding element structure that lines the housing 1, at least in certain sections.

The two contact legs 8, 8*a* are configured to be elongated and each lie against an inner wall of the housing 1, namely the side crosspieces 3, 4, indirectly or directly.

At least one latching element 20 is assigned to the second contact leg 8, which element engages into at least one recess and/or at least one undercut of the housing 1.

The first sliding elements 9 have elements 10 on the bottom side, which are held in the bottom 2, and elements 12 on the side crosspiece side, which are held in the first contact leg 8*a*. The elements 10 on the bottom side are connected with one another by means of constricting bridges 21. Undercuts are formed by the constrictions, and they fix the sliding elements 9 well in place in the housing 1.

Figure 5A:
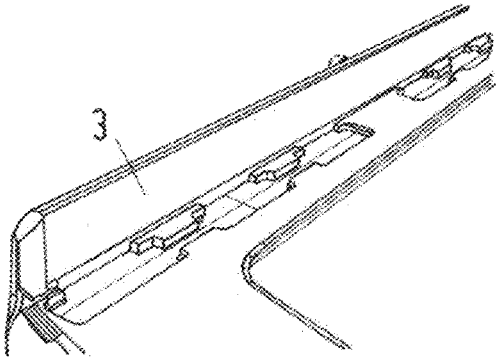
FIG. 5A shows a representation of part of the first depressions in the bottom, which are supposed to hold the first sliding elements.
Figure 5B:
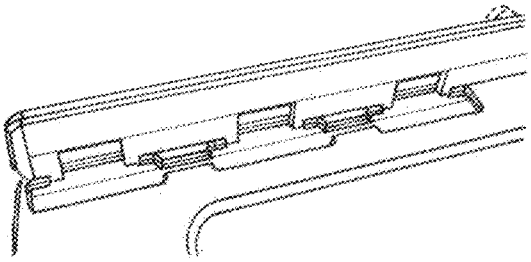
FIG. 5B shows a representation of part of the first contact leg, which is glued onto the first side crosspiece, wherein the first slide elements have not yet been clipped in place.
Figure 5C:
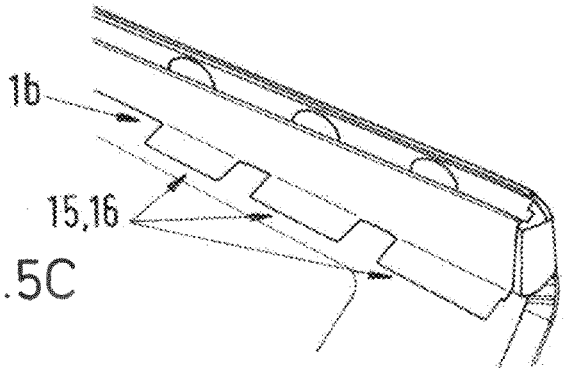
FIG. 5C shows a representation of part of the second contact leg that has been inserted.
Figure 5D:
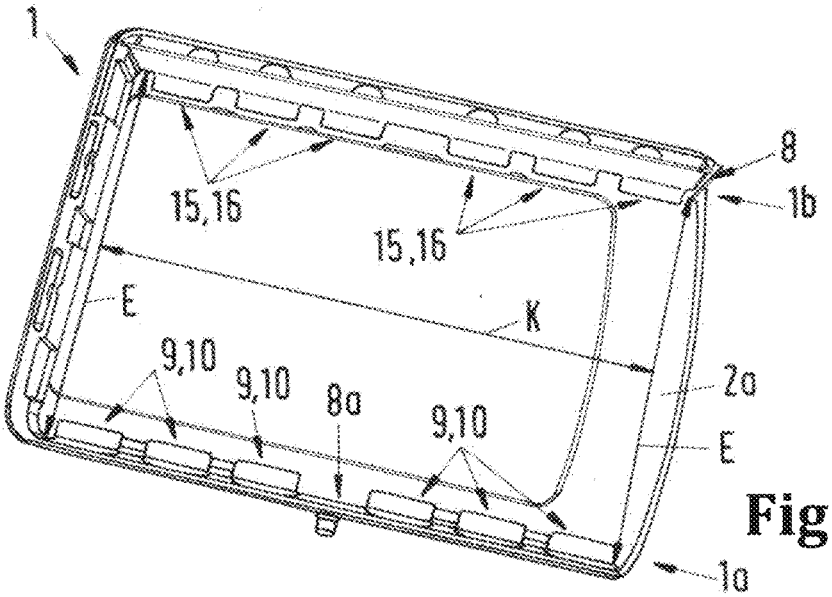
FIG. 5D shows the finished, assembled holding device without clip and lid.
Figure 6:
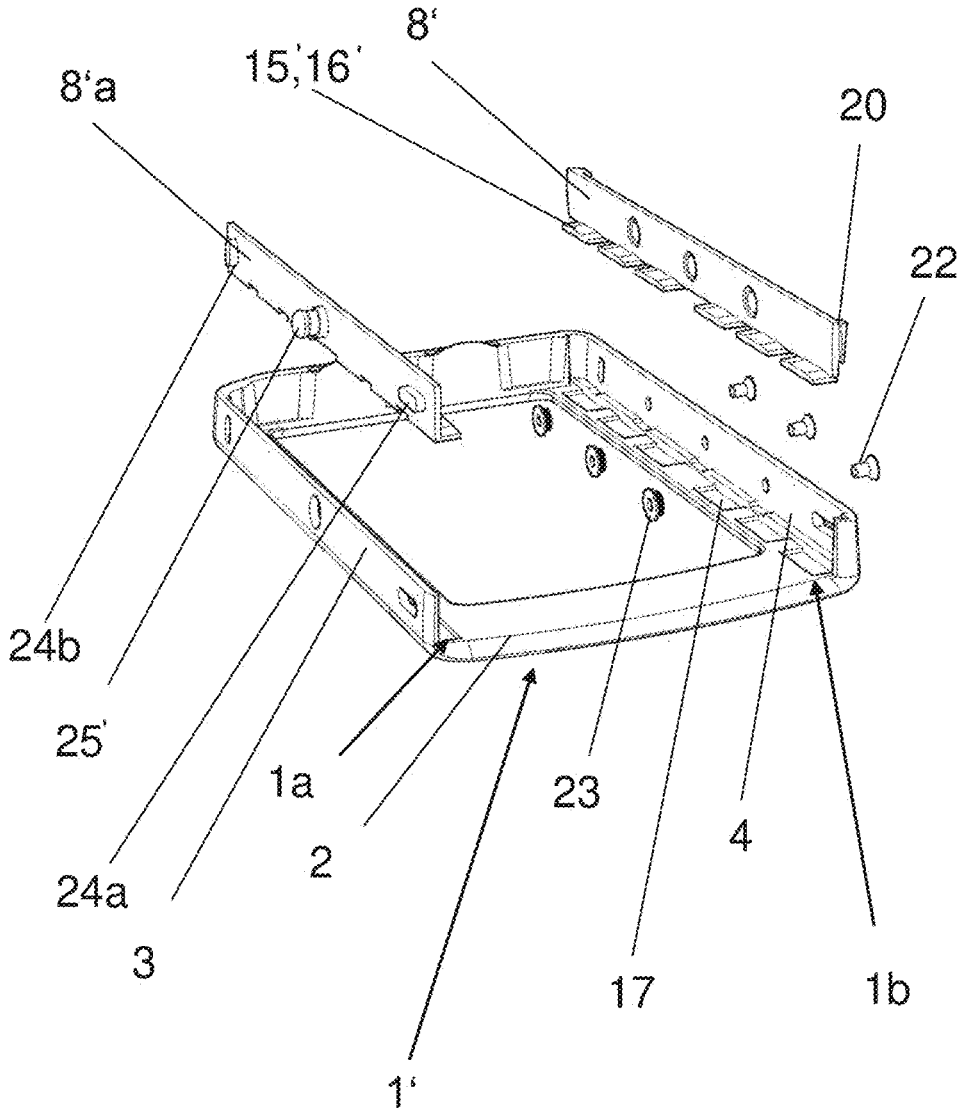
FIG. 6 shows a further embodiment of the holding device, wherein two contact legs are provided, which engage into the side crosspieces assigned to them with protrusions, studs or a coupling piece.

FIG. 1 and FIG. 5D show that because of the presence of the sliding elements 9, 15 and the sliding element structure within the housing 1, an insertion width E for a card is produced along a defined clamping length K, at least in certain sections, wherein the insertion width E is less than 53.95 mm. This insertion width E is less than a card width as an undersize.

Here, in concrete terms, the insertion width E is a distance that extends between the contact legs 8, 8*a* in their finished inserted state, which function as inner contact surfaces or newly inserted inner walls. However, the insertion width E could also be a distance that extends between elements, particularly on the side crosspiece side, of sliding elements that lie opposite one another in the housing 1. Of course, the distance can also extend between a sliding element, in particular its element on the side crosspiece side, and a contact leg, if they lie opposite one another in the housing.

FIGS. 6 to 11 show a further exemplary embodiment of a holding device, in which holding rivets 22 extend between the second contact leg 8' and the second side crosspiece 4, which rivets project through holes in the second side crosspiece 4 and into holes in the second contact leg 8', wherein the holding rivets 22 are connected with rivet heads 23 in the manner of snaps, which heads project into holes in the second contact leg 8'.

The holding rivets 22, together with the rivet heads 23, can pass through holes in a cover 7 and fix the latter in place between the second side crosspiece 4 and the second contact leg 8'.

The rivet heads 23 lie against the inner side of the second contact leg 8', the holding rivets 22, with their heads, lie against the outer side of the second side crosspiece 4. The rivet heads 23 align with the surface of the inner side of the second contact leg 8' in their final installed state. The heads of the holding rivets 22 align with the surface of the outer side of the second side crosspiece 4 in their final installed state.

Figure 9:
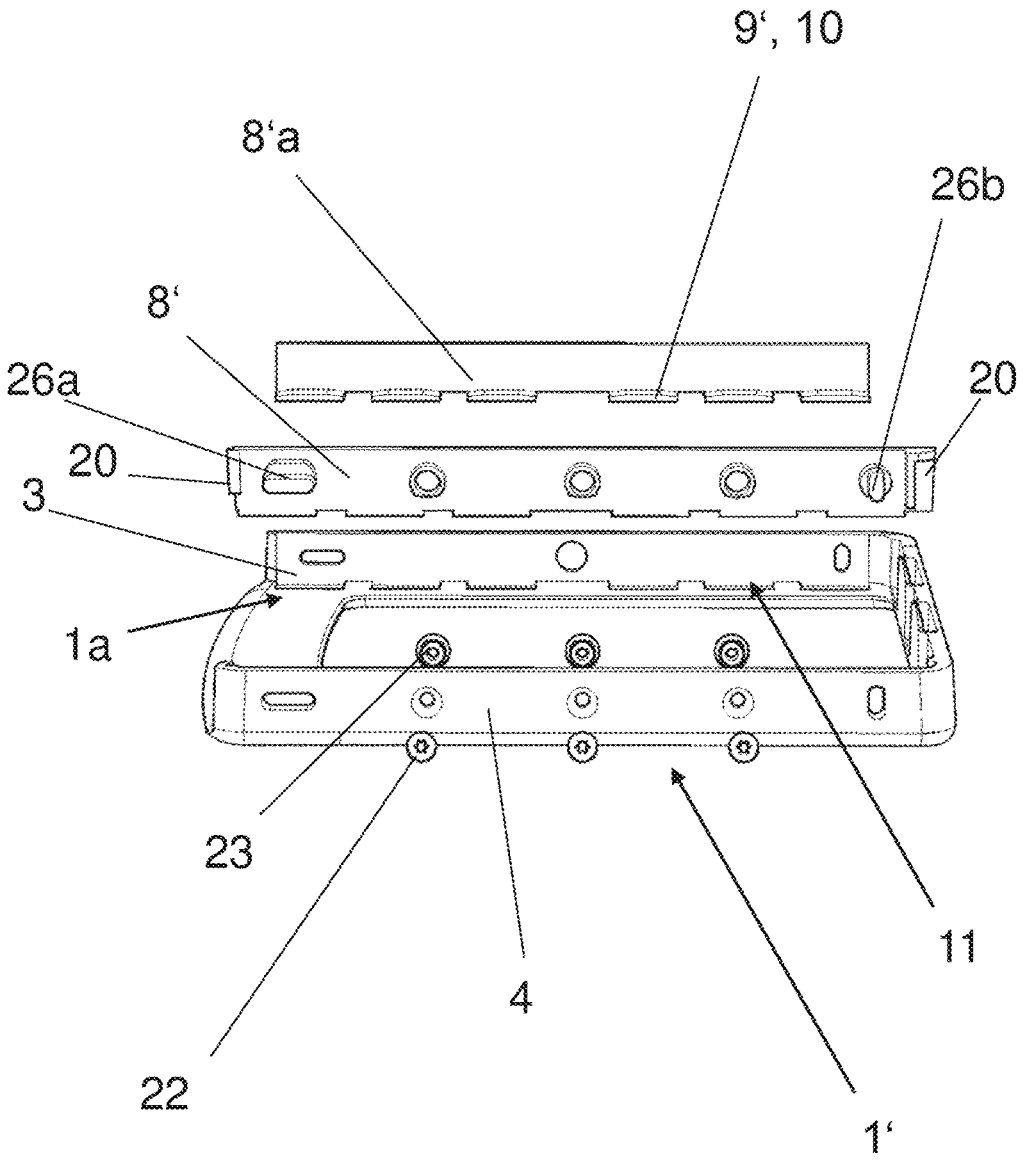
FIG. 9 shows a side view of the arrangement according to FIG. 6, onto the outside of the side crosspiece, on which the cover is arranged on the housing, to flip up in the manner of a hinge.
Figure 10:
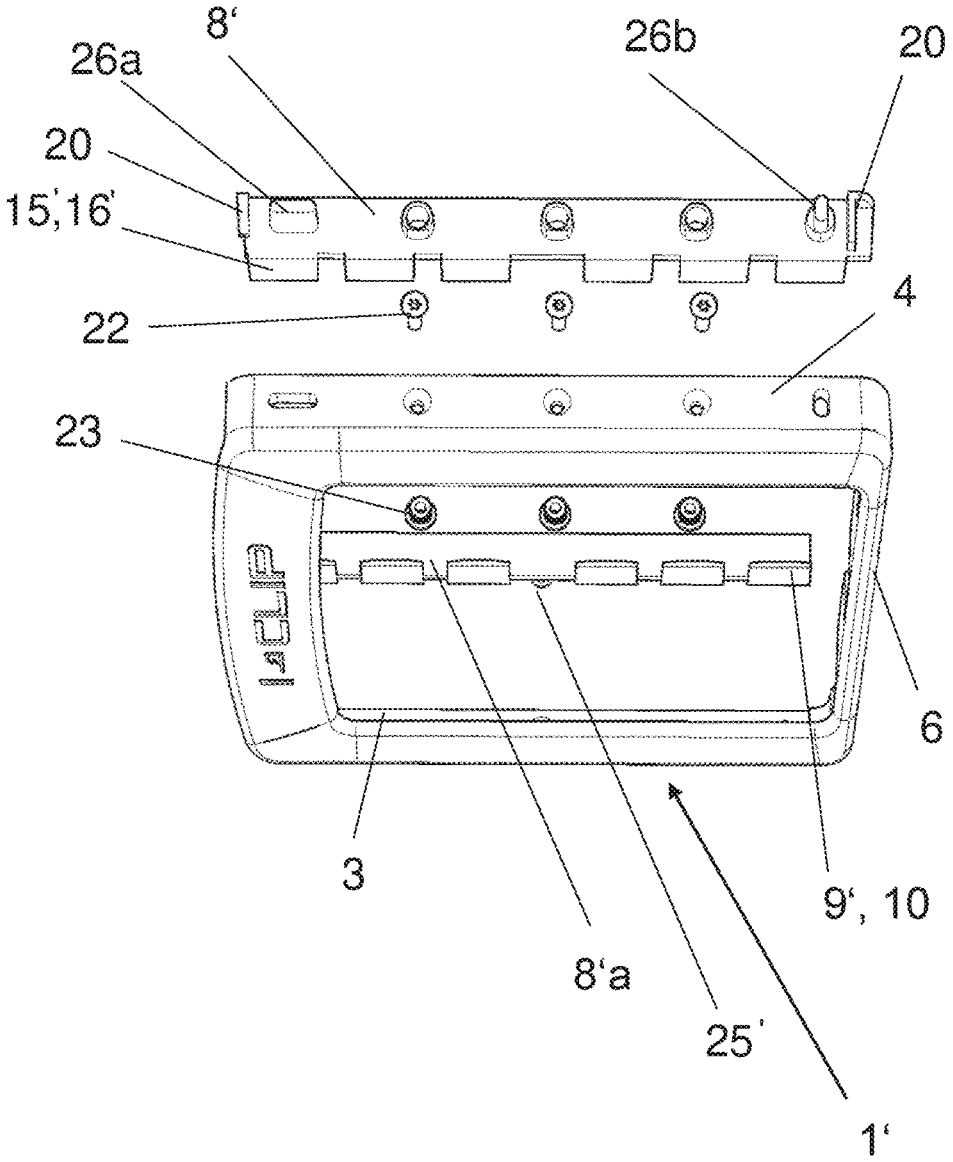
FIG. 10 shows a perspective view of the arrangement according to FIG. 6 from below, in the direction toward the bottom, which has been imprinted with a logo.
Figure 11:
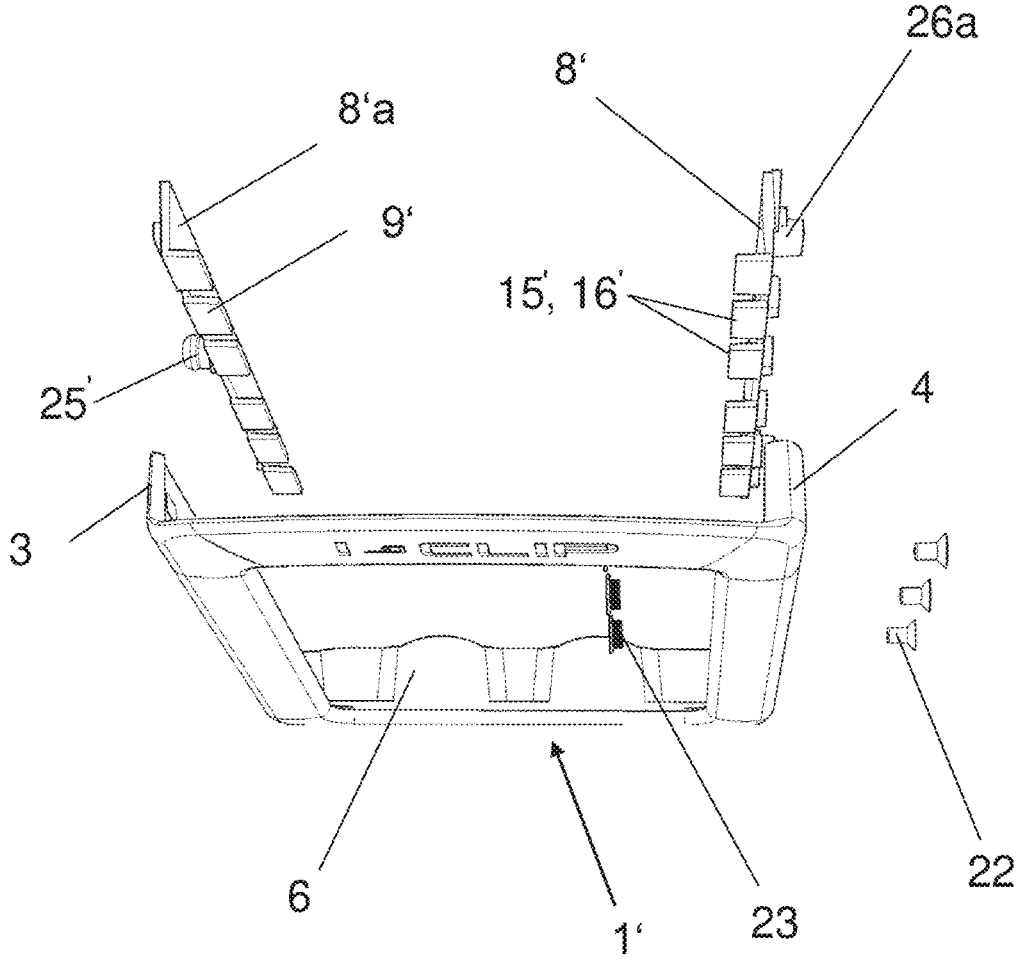
FIG. 11 shows a further perspective view of the arrangement according to FIG. 6 from below, in the direction toward the bottom imprinted with a logo and in the direction of the inner side of the connection crosspiece.
Figure 12:
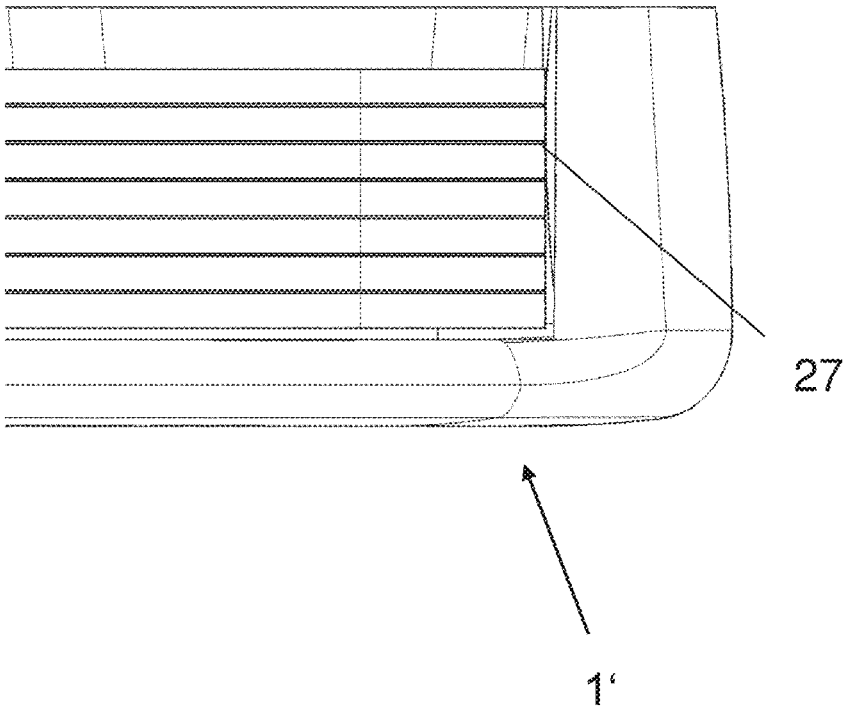
FIG. 12 shows a detail view of an inner wall structured in a convex bulbous manner, which wall applies more friction to the center cards of a stack of cards than to the cards situated on the bottom or the top of the stack of cards.
Figure 13:
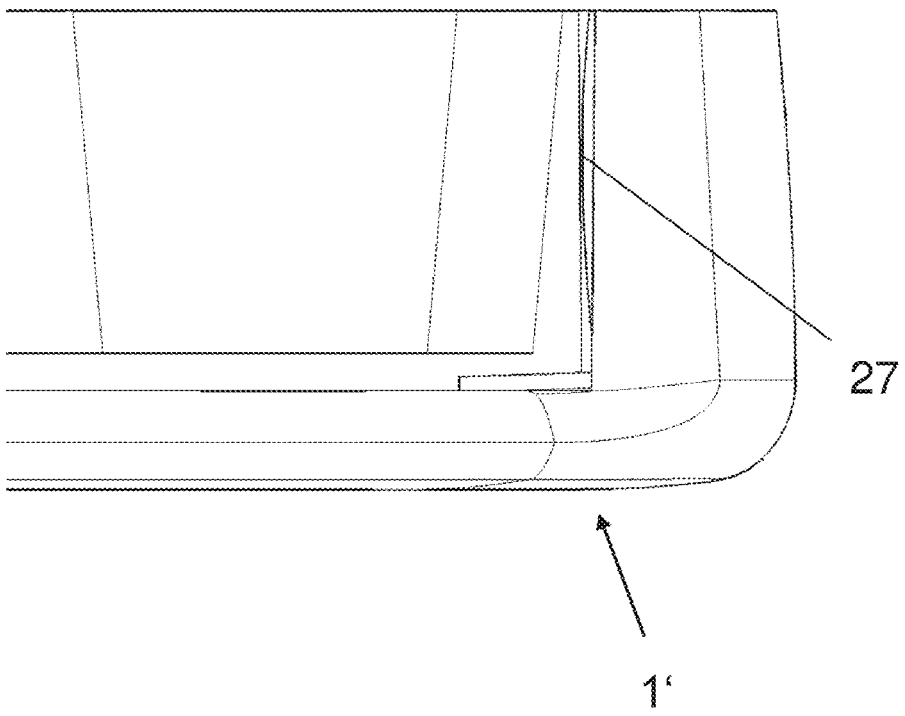
FIG. 13 shows a further view of the inner wall structured in a convex bulbous manner.
Figure 14:
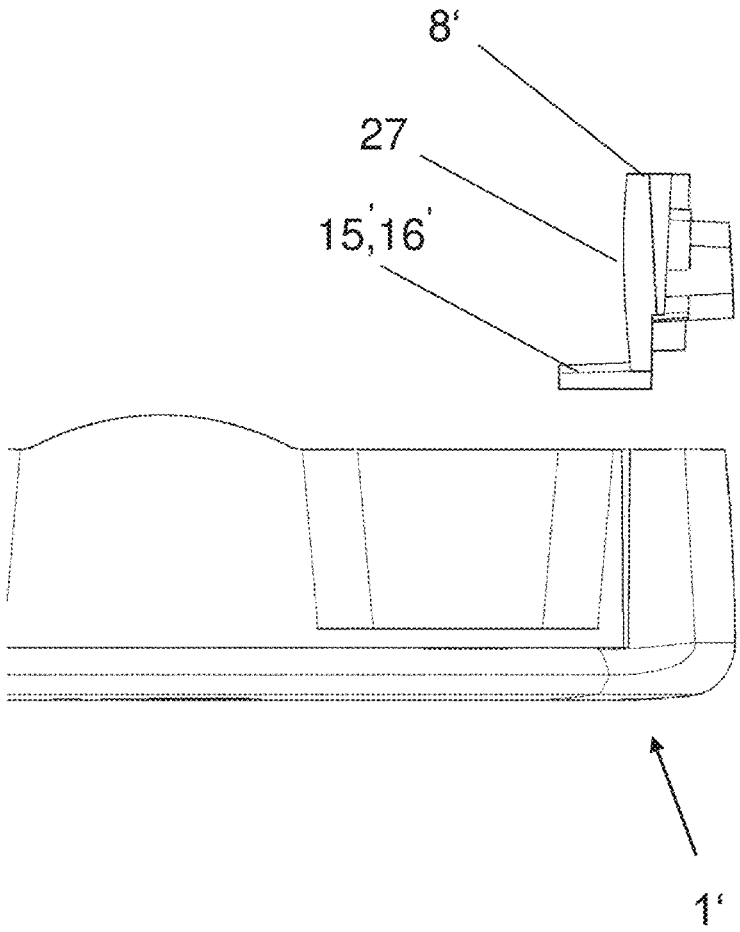
FIG. 14 shows a further view of the inner wall structured in a convex bulbous manner, which is formed on a contact leg.
Figure 15:
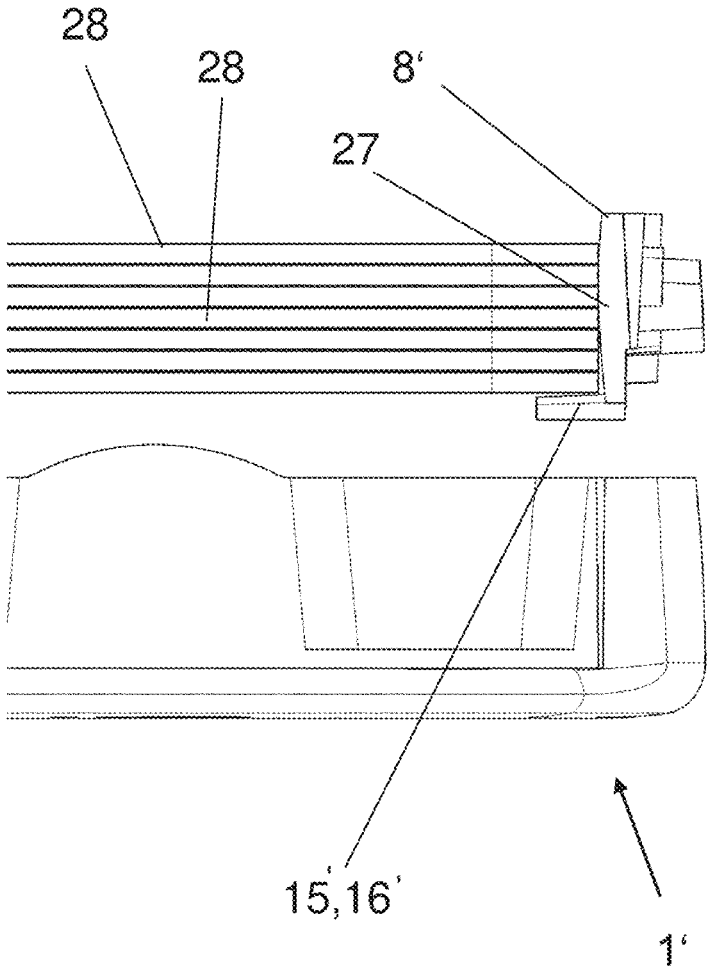
FIG. 15 shows a detail view of an inner wall structured in a convex bulbous manner, which wall applies more friction to the center cards of a stack of cards than to the cards situated on the bottom or the top of the stack of cards, wherein the contact leg has not yet been inserted into the housing.

FIGS. 9 and 11 show that the second contact leg 8' lies against the second side crosspiece 4 and engages into the latter with at least one stud 26*a*, 26*b*. In this concrete case, two studs 26*a*, 26*b* are provided, which are arranged at opposite ends of the second contact leg 8' and project away from it in the direction of the inner side of the second side crosspiece 4.

An elongated stud 26*a* is oriented essentially parallel to the bottom 2 with its longitudinal axis, the other stud 26*b* is oriented essentially orthogonal to the bottom 2 with its longitudinal axis. The studs 26*a*, 26*b* lie flush with the surface of the outer side of the second side crosspiece 4 in the final installed state.

Figure 7:
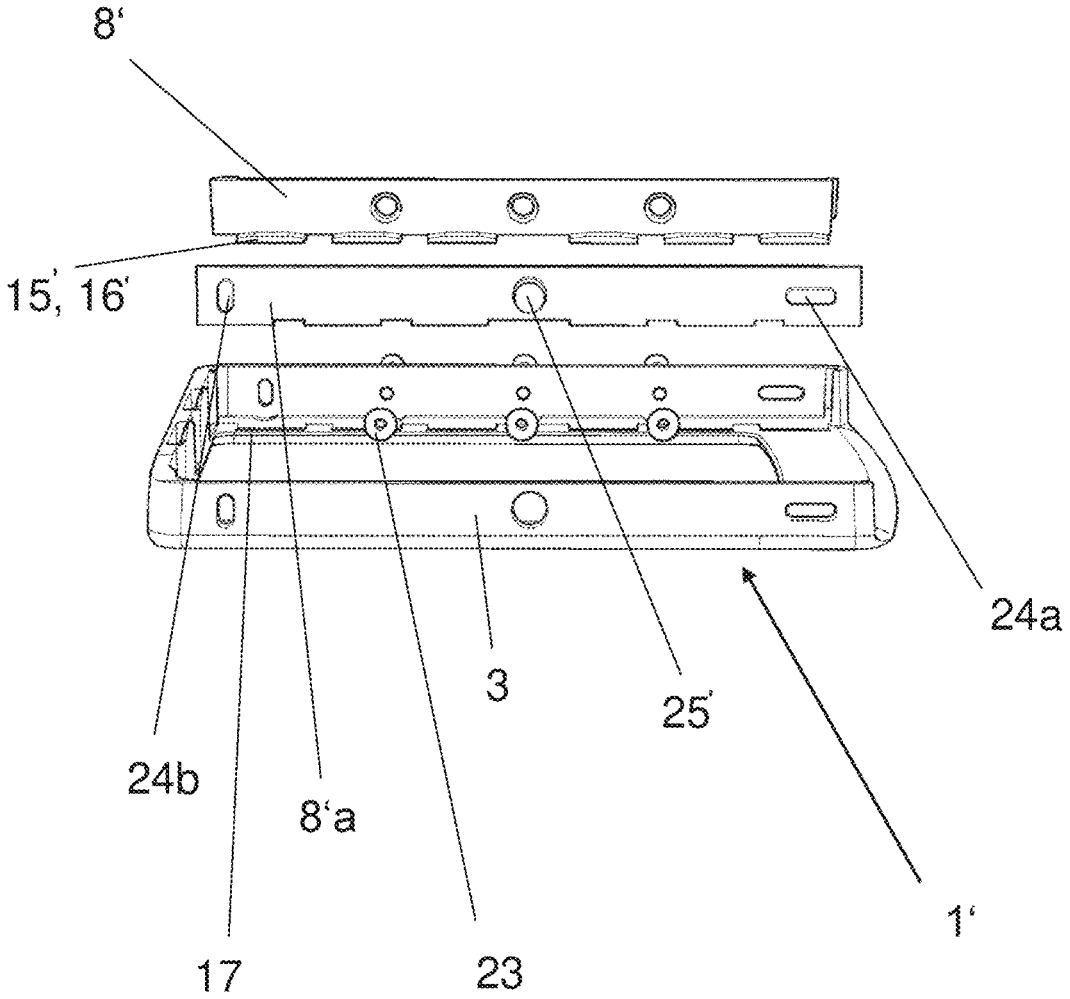
FIG. 7 shows a side view of the arrangement according to FIG. 6, onto the outside of the side crosspiece, at which the cover can be easily opened and closed.
Figure 8:
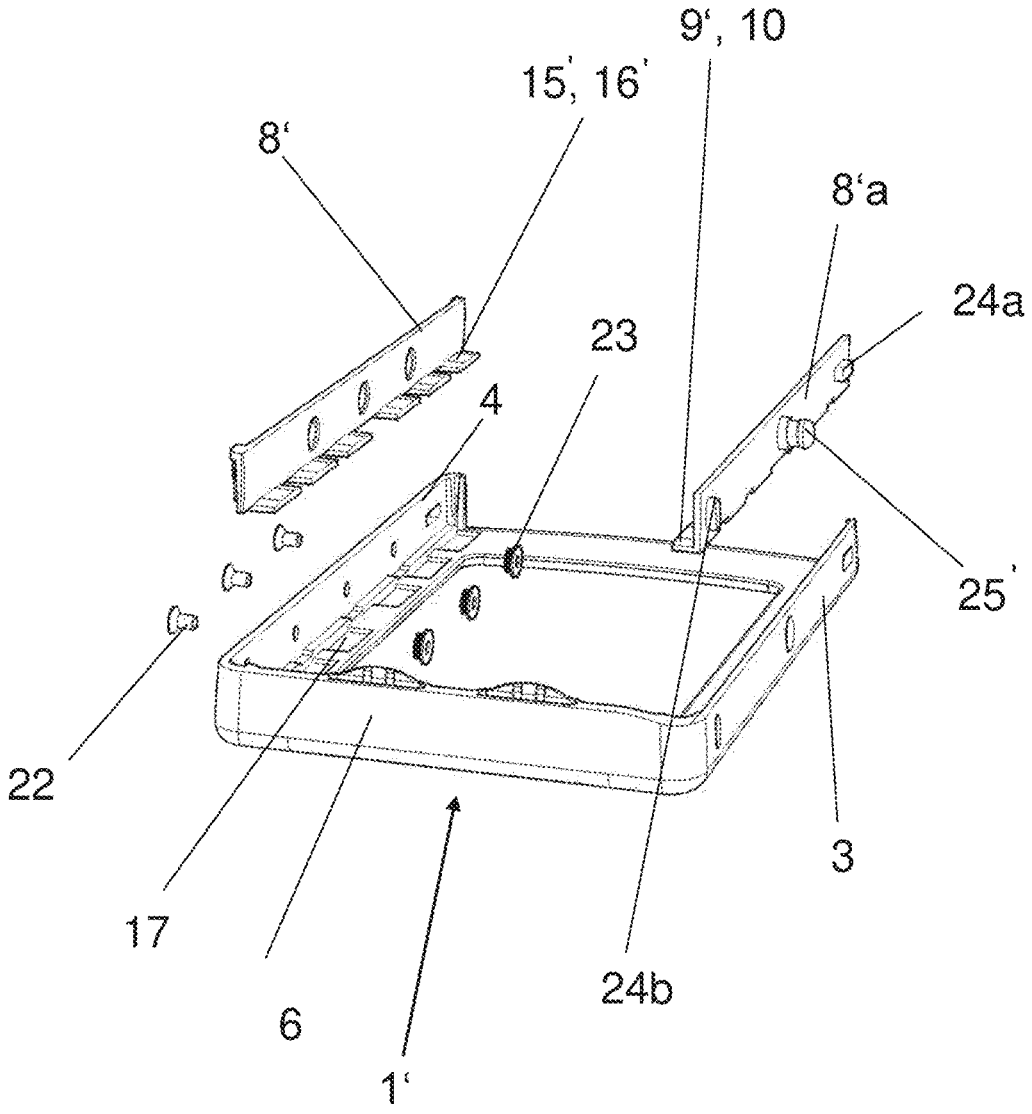
FIG. 8 shows a perspective view of the arrangement according to FIG. 6 in the direction toward the connection crosspiece.

FIGS. 7 and 8 show that the first contact leg 8'a lies against the first side crosspiece 3 and engages into it with at least one protrusion 24*a*, 24*b* and passes through it with a coupling piece 25 for the cover 7 according to FIG. 1.

In this concrete case, two protrusions 24*a*, 24*b* are provided, which are arranged at opposite ends of the first contact leg 8'a and project away from it in the direction of the inner side of the first side crosspiece 3. An elongated protrusion 24*a* is oriented essentially parallel to the bottom 2 with its longitudinal axis, the other protrusion 24*b* is oriented essentially orthogonal to the bottom 2 with its longitudinal axis. The protrusions 24*a*, 24*b* lie flush with the surface of the outer side of the first side crosspiece 3 in the final installed state.

The holes in the side crosspieces 3, 4, which hold the protrusions 24*a*, 24*b* and the studs 26*a*, 26*b*, are configured to be complementary to them, namely they have essentially the same cross-sectional shapes as the protrusions 24*a*, 24*b* and studs 26*a*, 26*b* that they hold.

FIGS. 12 to 15 show that an inner wall 27 of the housing 1 is configured in a bulbous convex manner. In this concrete case, it is shown that the second contact leg 8' has or forms such an inner wall 27.

Figure 16:
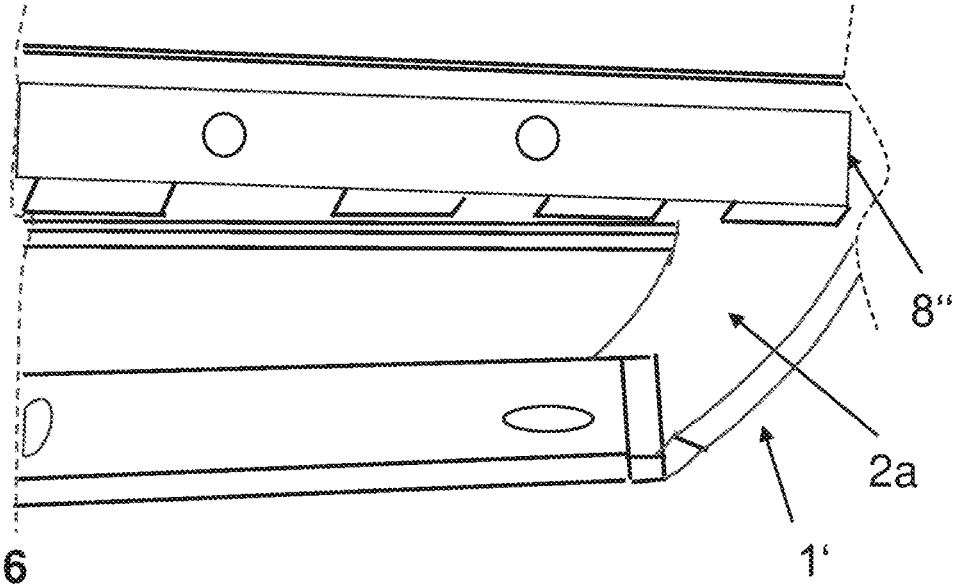
FIG. 16 shows as a detail, a housing into which a flexible contact leg of the type of a flexible inlay has been inserted.

FIG. 16, as a detail, a housing 1', into which a flexible contact leg 8" is inserted in the manner of a flexible inlay.

Figure 17:
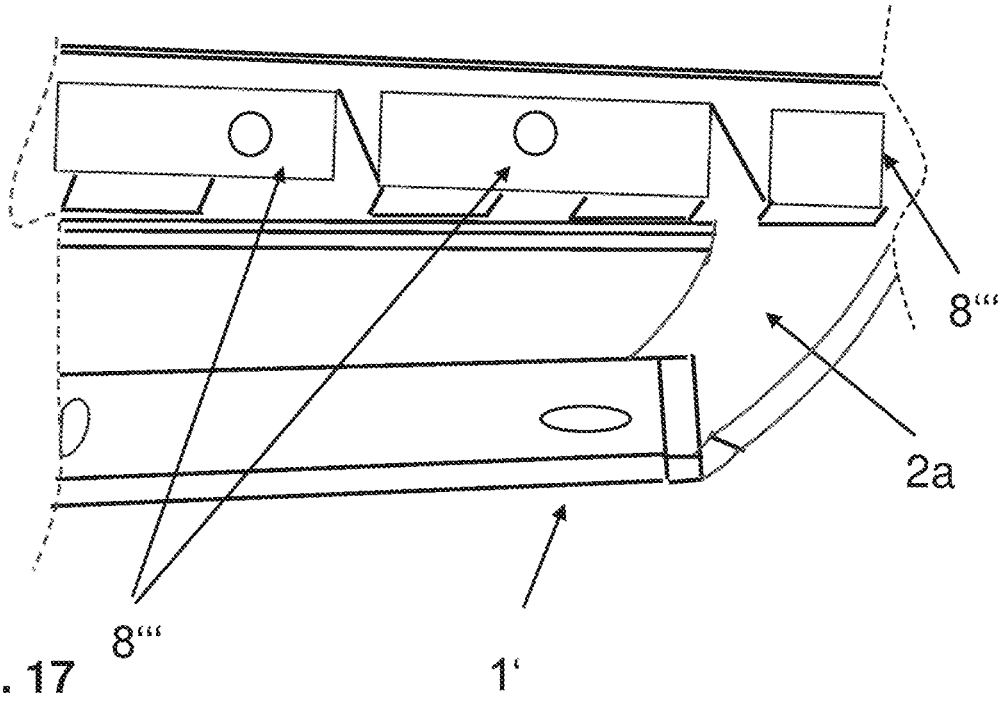
FIG. 17 shows as a detail, a housing into which multiple flexible contact legs of the type of flexible inlays have been inserted.

FIG. 17, as a detail, a housing 1', into which multiple contact legs 8'", which are shorter in comparison to FIG. 16, are inserted in the manner of flexible inlays.

Sliding elements that are situated on or in the bottom of the housing 1; and that are configured to be in one piece with and of the same material as the contact legs 8", 8'" are assigned to the flexible and elastically deformable contact legs 8", 8'" of FIGS. 16 and 17.

Figure 18:
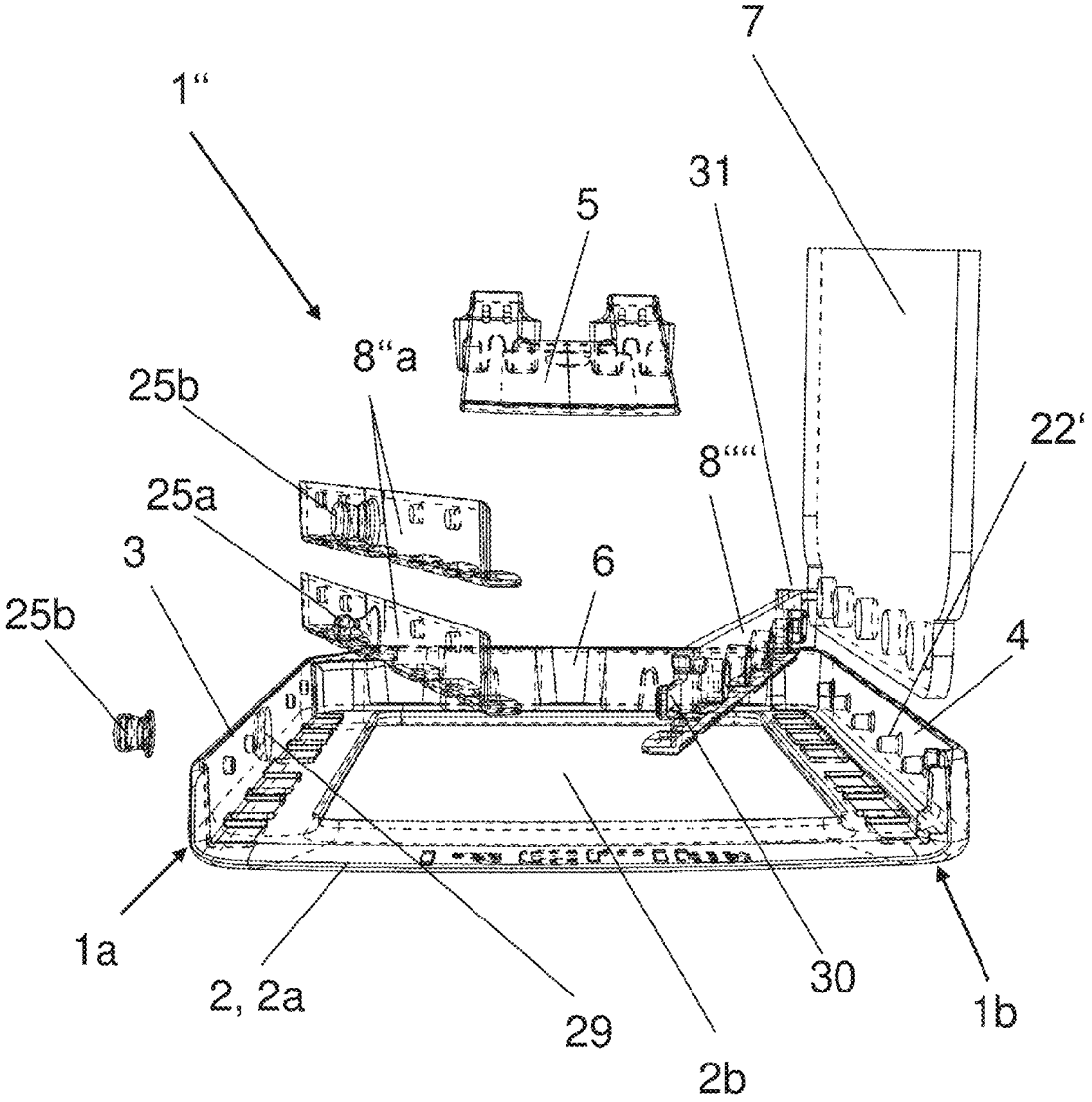
FIG. 18 shows a schematic exploded view of a further holding device, in which a first coupling piece part is connected in one piece with the first loose contact leg, which piece can engage into a second coupling piece part that has been produced separately, with shape fit, wherein the two coupling piece parts pass through a passage in the first side crosspiece.

FIG. 18 shows a schematic exploded view of a further holding device 1".

In the case of this holding device 1", a first coupling piece part 25*a* is connected with the first, loose contact leg 8"a, which is shown double, in one piece and of the same material, which piece can engage into a second coupling piece part 25*b*, produced separately, with shape fit.

The two coupling piece parts 25*a*, 25*b* jointly pass through a round passage 29 in the first side crosspiece 3 and thereby form a male part of a snap for attaching the cover 7.

Furthermore, a loose cover 7 is shown, which can be connected with the second side crosspiece 4 by means of a second loose contact leg 8"".

Finally, a loose clip 5 is also shown, which can be inserted into the connection crosspiece 6.

Figure 19:
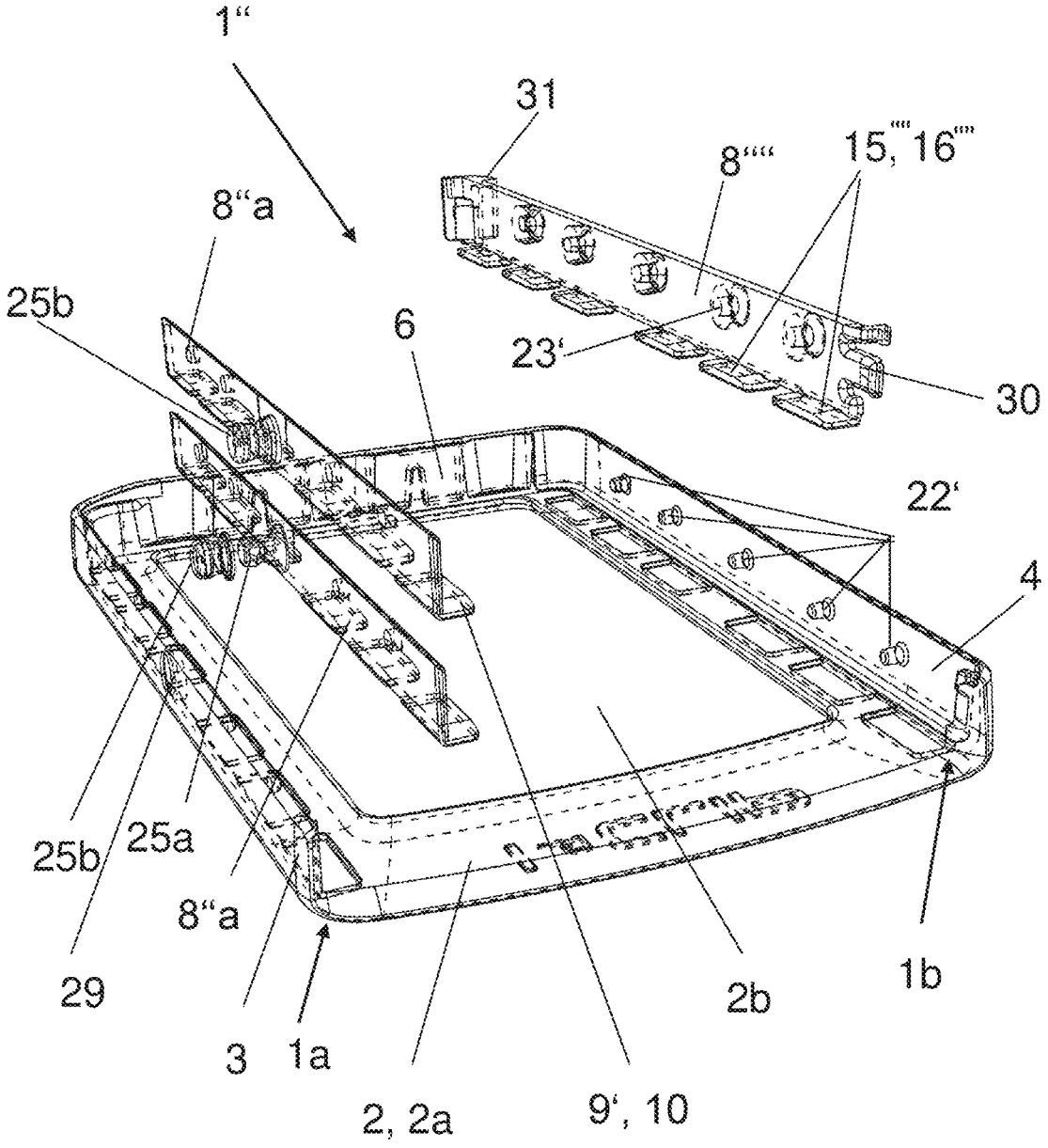
FIG. 19 shows a further view of the holding device according to FIG. 18, without clip and lid.

FIG. 19 shows a further view of the holding device 1" according to FIG. 18, without clip 5 and cover 7. A wedge 31 is formed on the second contact leg 8"", which wedge is arranged on the end of the contact leg 8"" that faces the connection crosspiece 6.

The wedge 31, which can be provided in the case of all the embodiments of the second contact leg shown here, engages into a recess in the housing 1" and presses the second contact leg 8"" against a cover 7, not shown here, in a suitable manner, specifically in such a manner that a desired inner dimension between the contact legs or the inner sides created by the contact legs is present in the housing 1".

FIGS. 18 and 19 show that a tongue 30 is formed on the second contact leg 8"", which tongue faces the card insertion region and can engage around round corners of plastic cards that are being held and thereby protect them from friction wear.

The tongue 30 also protects the plastic cards from slipping out of the housing 1".

The tongue 30 is formed on a longitudinal end of the contact leg 8"". The contact leg 8"" therefore has the tongue 30 for engaging around corners of plastic cards inserted into the housing 1".

Figure 20:
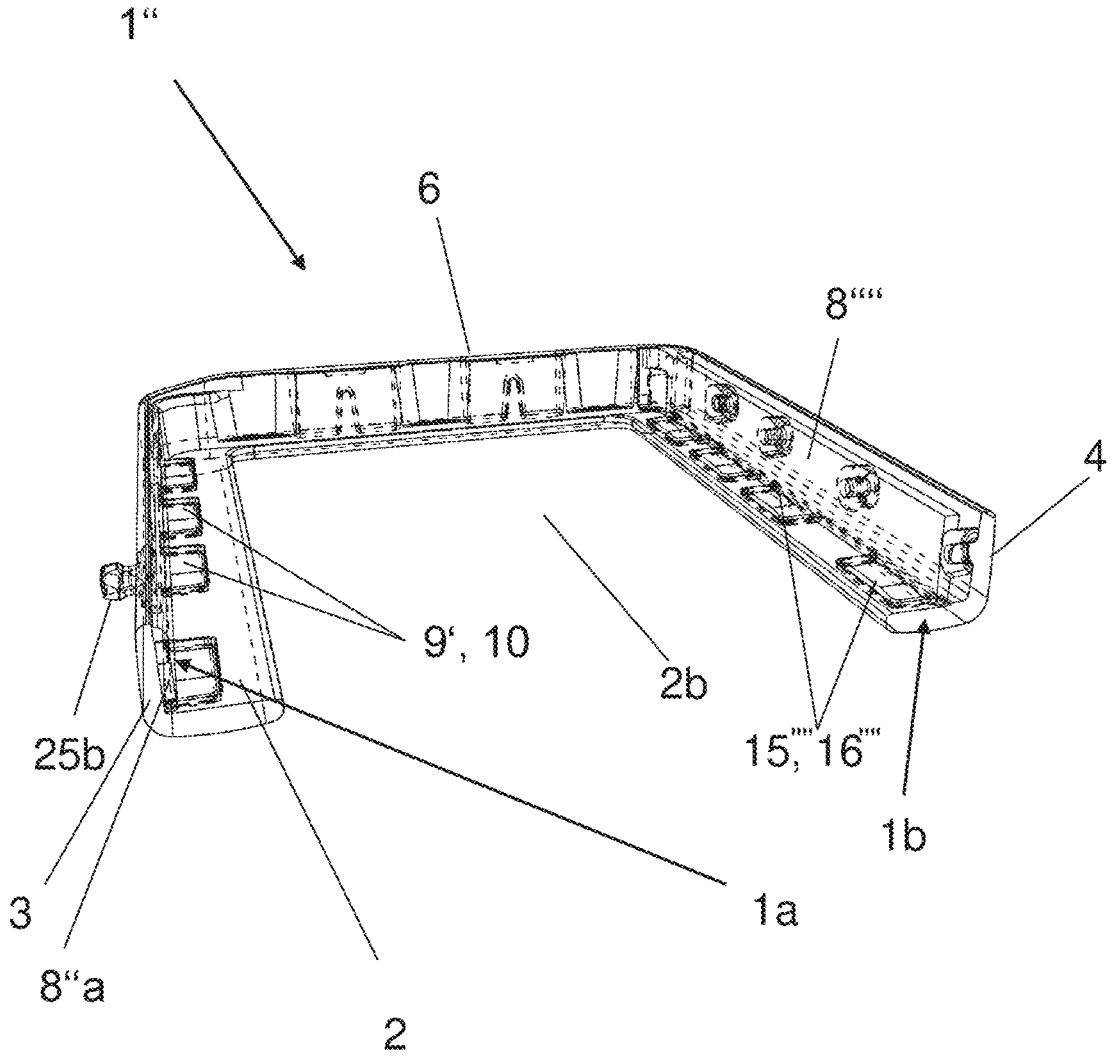
FIG. 20 shows a further view of the holding device according to FIG. 18, without clip and lid, in the assembled state.

FIG. 20 shows a further view of the holding device 1" according to FIG. 18, without clip 5 and cover 7, in the assembled state, namely when the contact legs 8"a, 8"" are held against the side crosspieces 3, 4 with shape fit, material fit and/or force fit.

Figure 21:
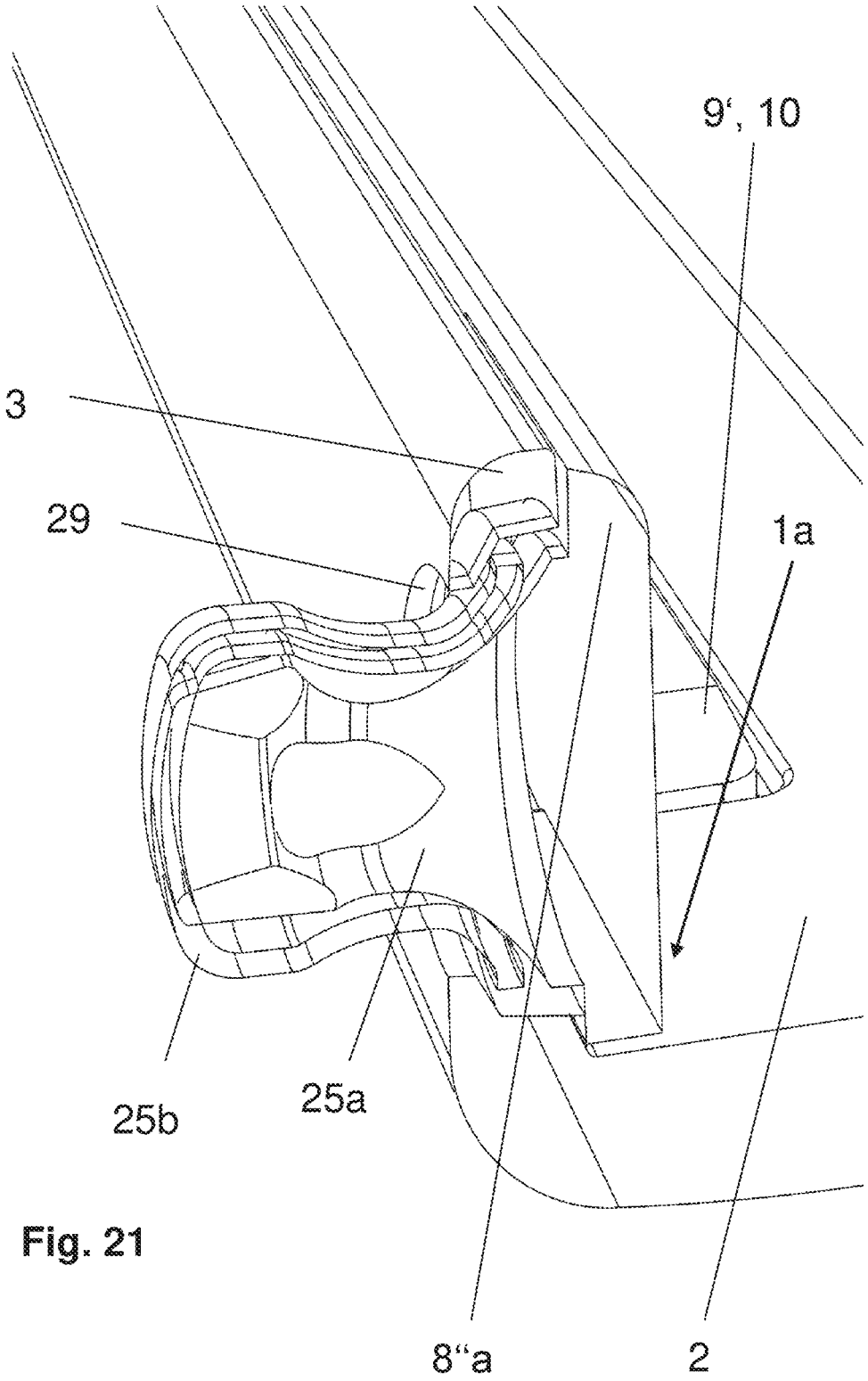
FIG. 21 shows as a detail, a sectional view through the two coupling piece parts, through the first contact leg, and through the first side crosspiece, against which the first contact leg lies.

FIG. 21 shows, as a detail, a sectional view through the two coupling piece parts 25*a*, 25*b*, through the first contact leg 8"a, and through the first side crosspiece 3, against which the first contact leg 8"a lies firmly.

The second coupling piece part 25*b* is produced from metal. The first coupling piece part 25*a*, like the contact leg 8"a, is produced from plastic.

Figure 22:
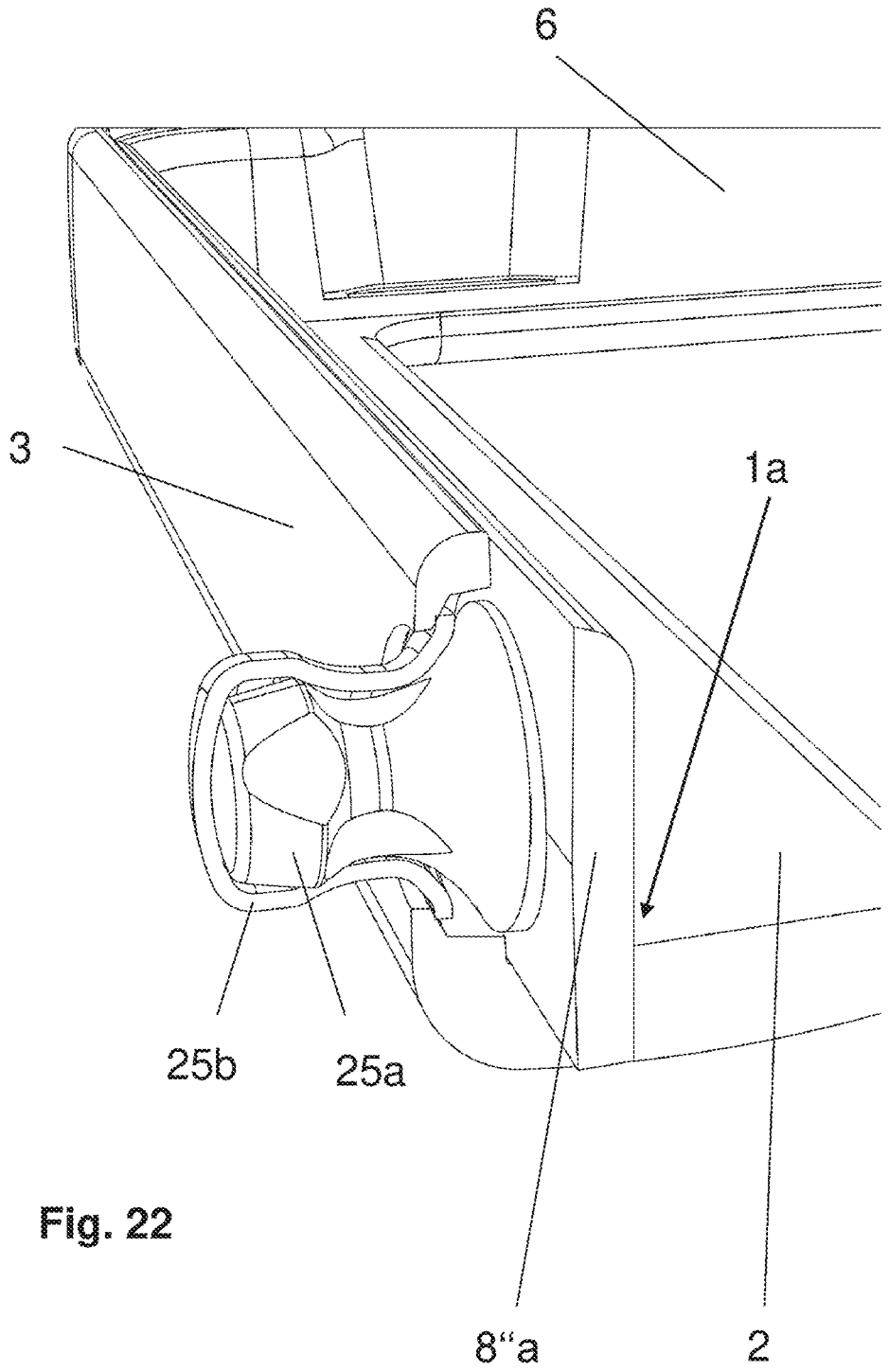
FIG. 22 shows a further detail sectional view through the second coupling piece part, which passes through the passage in the first side crosspiece and lies against an inner side of the crosspiece with an edge, wherein the first coupling piece part also passes through the passage in the first side crosspiece and engages into the second coupling piece part, which is configured to be hollow, with shape fit.

FIG. 22 shows a further detail sectional view through the second coupling piece part 25*b*, which passes through the passage 29 in the first side crosspiece 3 and lies against the inner side of the crosspiece with an edge, wherein the first coupling piece part 25*a* also passes through the passage 29 in the first side crosspiece 3 and engages into the second coupling piece part 25*b*, which is configured to be hollow, with shape fit.

The contact leg 8"a is in one piece with the first coupling piece part 25*a*, which piece engages into the second coupling piece part 25*b*, which is produced separately, with shape fit, wherein the two coupling piece parts 25*a*, 25*b* jointly pass through the passage 29 in the side crosspiece 3.

The second coupling piece part 25*b* is produced from metal and serves as the male part of a snap for setting the cover 7 on.

In this regard, the second coupling piece part 25*b* engages behind the frame or the first side crosspiece 3 and also serves as a holder for the first coupling piece part 25*a*, which engages into the second coupling piece part 25*b*.

Pin-like holding rivets 22' that are configured integral with and in one piece with the second side crosspiece 4 project inward from the crosspiece, so as to be able to engage into the contact leg 8''''.

Rivet heads 23' can be arranged or configured in the contact leg 8'''', which heads interact with the holding rivets 22'.

The first contact leg 8''a has sliding elements 9', 10 that are configured in one piece with it. The second contact leg 8'''' also has sliding elements 15, 16 configured in one piece with it.

The sliding elements 9', 10, 15, 16 are assigned to corner regions 1*a*, 1*b* of the housing 1''. The corner regions 1*a*, 1*b* are formed by means of a bottom plane, on which the cards lie in the inserted state, and by means of inner wall planes that extend essentially orthogonally to this bottom plane.

The housing 1 can be produced, in particular, from metal, a ceramic, a carbon material, a precious metal, from titanium, a plastic or other materials. The housing 1 can be produced, in particular, by means of a powder injection molding method. Inorganic materials such as metals or ceramics can be processed by means of powder injection molding.

A housing 1 that consists essentially completely of inorganic material can be formed individually in three dimensions relatively without problems, and can be modified with regard to its physical properties, its roughness and/or its haptics, in such a manner that cards and/or banknotes are held in a gentle manner.

Metals and ceramics can be brought into complex shapes, by means of chip-cutting or casting, with greater difficulty than plastics. For this reason, metal powders or ceramic powders are mixed with plastics and then brought into the complex shape of the housing 1 by means of powder injection molding. Afterward the plastic is removed. The housing 1, which has been produced by means of powder injection molding, can then be sintered. The housing 1 is then essentially purely inorganic, in particular metallic or ceramic.

A housing 1 that is open toward the top and has a bottom 2, wherein the bottom 2 has side crosspieces 3, 4 that project upward and are arranged at a distance from one another, can be produced by means of a powder injection molding method, for a holding device of the type described here. The holding device can have a clip 5, but does not have to have one.

The powder injection molding method comprises the method steps mixing a metal powder or ceramic powder with a plastic, bringing this mixture into the shape of the housing 1, removing the plastic and hardening the housing 1.

Sliding element structures or further related components for stabilization can then be inserted into such a housing 1. Of course, clips 5 or covers 7 can also be inserted as exchangeable parts.

REFERENCE SYMBOLS

1, 1', 1'' housing
1*a*, 1*b* corner region of 1, 1', 1''
2 bottom
2*a* front transverse crosspiece of 2
2*b* access opening of 2
3 first side crosspiece
4 second side crosspiece
5 clip
6 connection crosspiece
7 cover
8, 8', 8'''' second elongated contact leg
8'', 8'''flexible contact leg, inlays and simultaneously sliding elements
8*a*, 8'a, 8''a first elongated contact leg
9, 9' first sliding element
10 element of 9, 9' on the bottom side
11 first depression in 2
12 element of 9 on the side crosspiece side
13 locations on 8*a*
14 gap in 8*a*
15 second sliding element
16 element of 15 on the bottom side
17 second depression in 2
18 first holding ribs of 4
19 second holding ribs of 8
20 latching element of 8, 8'
21 bridge of 9
22, 22' holding rivet
23, 23' rivet head
24*a*, 24*b* protrusion of 8'a
25 coupling piece of 8'a
25*a* first coupling piece part on 8''a
25*b* second coupling piece part
26*a*, 26*b* studs of 8'
27 convex bulbous inner wall of 8'
28 card
29 passage in 3
30 tongue on 8''''
31 wedge

What is claimed is:

1. A holding device for cards and/or banknotes, comprising a cover, a housing for holding the cards and/or banknotes, and a clip held in the housing, wherein the housing comprises a sliding element structure produced separately from the housing and assigned to the housing, wherein the sliding element structure extends over a corner region of the housing, wherein the sliding element structure comprises a plurality of sliding elements and a contact leg, wherein the sliding elements and the contact leg are connected with one another or configured in one piece, wherein the contact leg lies against an inner wall surface of the housing, wherein the sliding elements have elements on a bottom side held in depressions of a bottom of the housing and press the contact leg against a side crosspiece of the housing, and wherein the sliding element structure lines the housing, at least in certain sections, and the cover is held, indirectly or directly, by the sliding element structure.

2. The holding device according to claim 1, wherein the housing is open toward a top, wherein a plurality of side crosspieces assigned to the bottom project upward and are spaced apart from one another.

3. The holding device according to claim 1, wherein the sliding elements or the contact leg or the sliding elements and the contact leg are configured to be elastically deformable and/or flexible.

4. The holding device according to claim 2, wherein a side crosspiece of the side crosspieces has a gap on an inner wall of the side crosspiece, which gap holds an element on the side crosspiece side, wherein the gap is formed out of the side crosspiece.

5. The holding device according to claim 1, wherein holding ribs or holding rivets for passing through holes in an edge of a cover extend between the contact leg and the side crosspiece.

6. The holding device according to claim 1, wherein first holding ribs are formed on the side crosspiece and are configured to be complementary to second holding ribs on the contact leg, so that the second holding ribs engage into the first holding ribs.

7. The holding device according to claim 1, wherein the contact leg is configured to be elongated and the inner wall surface of the housing comprises the side crosspiece.

8. The holding device according to claim 1, wherein the contact leg has a latching element or a wedge, which latching element or wedge engages into at least one of a recess and an undercut of the housing.

9. The holding device according to claim 1, wherein by means of the sliding element structure within the housing, an insertion width for a card is produced along a defined clamping length, at least in certain sections, wherein the insertion width is greater than 52 mm and less than 53.98 mm.

10. The holding device according to claim 1, wherein holding rivets extend between the contact leg and the side crosspiece, which holding rivets project through at least one of holes in the contact leg and holes in the side crosspiece, wherein the holding rivets are connected with rivet heads that project into at least one of the holes in the contact leg and the holes in the side crosspiece.

11. The holding device according to claim 1, wherein the contact leg engages into the side crosspiece with a protrusion or a stud and/or passes through the side crosspiece with at least one of a protrusion, a stud and a coupling piece.

12. The holding device according to claim 1, wherein the contact leg has a first coupling piece part that engages into a second coupling piece part, wherein at least one of the first coupling piece part and the second coupling piece part pass through a passage in a side crosspiece.

13. The holding device according to claim 1, wherein the contact leg has a tongue for engaging around corners of plastic cards inserted into the housing.

* * * * *